US012480751B2

(12) United States Patent
Whitehead

(10) Patent No.: US 12,480,751 B2
(45) Date of Patent: Nov. 25, 2025

(54) AMMUNITION DECAPPING APPARATUS

(71) Applicant: Kevin Gerald Whitehead, Roleystone (AU)

(72) Inventor: Kevin Gerald Whitehead, Roleystone (AU)

( * ) Notice: Subject to any disclaimer, the term of this patent is extended or adjusted under 35 U.S.C. 154(b) by 288 days.

(21) Appl. No.: 18/273,541

(22) PCT Filed: Jan. 28, 2022

(86) PCT No.: PCT/AU2022/050041
§ 371 (c)(1),
(2) Date: Jul. 20, 2023

(87) PCT Pub. No.: WO2022/174281
PCT Pub. Date: Aug. 25, 2022

(65) Prior Publication Data

US 2024/0125583 A1 Apr. 18, 2024

(30) Foreign Application Priority Data

Feb. 17, 2021 (AU) ..... 2021900402

(51) Int. Cl.

| | |
|---|---|
| ***F42B 33/04*** | (2006.01) |
| ***F42B 3/00*** | (2006.01) |
| ***F42B 33/00*** | (2006.01) |
| ***F42B 33/10*** | (2006.01) |

(52) U.S. Cl.
CPC ..... *F42B 33/04* (2013.01); *F42B 33/002* (2013.01); *F42B 33/10* (2013.01)

(58) Field of Classification Search
CPC ..... G42B 33/002; G42B 33/04; G42B 33/10
USPC ..... 86/36, 37
See application file for complete search history.

(56) References Cited

U.S. PATENT DOCUMENTS

| | | | | |
|---|---|---|---|---|
| 358,769 | A * | 3/1887 | Boyd | F42B 33/005 86/24 |
| 2,523,278 | A | 9/1950 | Carl, Jr. | |
| 3,180,204 | A * | 4/1965 | Sampson | F42B 33/04 86/37 |
| 4,836,078 | A * | 6/1989 | Lee | F42B 33/04 86/39 |

(Continued)

FOREIGN PATENT DOCUMENTS

| | | | |
|---|---|---|---|
| CN | 112025741 | A | 12/2020 |

OTHER PUBLICATIONS

"International Search Report"; prepared for application No. PCT/AU2022/050041; authorized officer Andrew Burgess; Mar. 7, 2022; 5 pages.

*Primary Examiner* — Bret Hayes
(74) *Attorney, Agent, or Firm* — Jackson Walker LLP

(57) ABSTRACT

Provided is ammunition decapping apparatus 10 comprising a decapping platform 12, a case receptacle 14, a die gantry 40 arranged over the decapping platform 12 and including a reciprocating die mount 42, and a case feeder 46 configured to operatively feed a case upright onto the decapping platform 12. Also included is a case urger 48 configured to urge a case fed from the case feeder 46 into the case receptacle 14, and an actuator arrangement 50 configured to actuate the case urger 48 and die mount 42 so that a case is fed into the decapping receptacle 14 and a die 44 mounted in the die mount 42 is able to decap the case.

20 Claims, 9 Drawing Sheets

(56) References Cited

U.S. PATENT DOCUMENTS

| | | | | |
|---|---|---|---|---|
| 5,309,813 | A * | 5/1994 | Henley | F42B 33/10 86/24 |
| 5,763,810 | A | 6/1998 | Lee | |
| 10,076,781 | B1 | 9/2018 | Lee | |
| 10,295,322 | B1 * | 5/2019 | Burke | B25B 27/14 |
| 2004/0025677 | A1 * | 2/2004 | Koch | F42B 33/10 86/24 |
| 2020/0271429 | A1 * | 8/2020 | Kinney | F42B 33/04 |

* cited by examiner

AMMUNITION DECAPPING APPARATUS

TECHNICAL FIELD

This invention relates to the field of ammunition, in general, and more specifically to an ammunition decapping apparatus and an associated method for decapping ammunition.

BACKGROUND ART

The following discussion of the background art is intended to facilitate an understanding of the present invention only. The discussion is not an acknowledgement or admission that any of the material referred to is or was part of the common general knowledge as at the priority date of the application.

As is known in the field of firearms, a cartridge is a type of ammunition generally packaging a bullet, a propellant substance (usually either smokeless powder or black powder) and a primer within a metallic case or casing that is precisely made to fit within the firing chamber of a firearm. After firing in a suitable firearm, the bullet is propelled out of the case by explosive expansion of the propellant following ignition thereof by the primer, with the case then ejected or removed from the breech of the firearm.

These cartridge cases are generally manufactured from brass and form a large proportion of the cost of a cartridge. However, with proper maintenance, such cases can typically be reused many times in a practice known as reloading, handloading or remanufacturing.

Reloading is the process of loading firearm cartridges by assembling the individual components (case, primer, powder, and bullet), rather than purchasing completely assembled, factory-loaded ammunition. Economy, increased accuracy, performance, customisability, commercial ammunition shortages, and hobby interests are all common motivations for reloading of cartridges.

The steps in reloading are generally recovering or obtaining spent brass cases, cleaning the brass to remove any dirt or stains, resizing the case and removing or decapping the spent primer via an appropriate die, installing a new primer, placing a new powder charge in the case, seating a new bullet and crimping the case around the bullet.

A number of methods have been developed to decap or remove spent primers and is usually accomplished using a specific die, typically being small diameter pin on a stem that goes through the central flash hole of a cartridge to contact the underside of the anvil in the spent primer and push the primer and anvil out of the rear pocket in the cartridge. This method is widely adopted in the art and most decapping dies or die sets incorporate such a pin in either a sizing die, a case mouth expanding die or a dedicated decapping die. Similarly, the process of replacing or inserting a new primer is essentially a reverse of the decapping process above.

Additionally, the process of reloading is normally accomplished within a reloading press but to improve longevity of the reloading press and components the brass case is typically cleaned using a dry or wet cleaning method. Historically, cases were cleaned using a dry tumbling method but advances in safety practices have resulted in wet cleaning being a more preferred method. The wet cleaning process also removes lead or contaminant residue from the cases better than the dry method.

One of the limitations of the wet cleaning method is the need to remove the primer before wet cleaning. Wet cleaning can result in corrosion between the case body if left wet for any period of time and this can make primer removal difficult. In addition, wet cleaning of a case with a primer left in can result in primer residue staining or contaminating the case with lead compound leading to health risks. Also, the removal of the primer is considered necessary to optimise the case cleaning as the pocket in which the primer sits is often contaminated and the general reloading community considers wet cleaning after the primer is removed to offer the best end result. This requires the cases to be cleaned twice and this adds significantly to the time and cost of reloading.

Conventional decappers are known, with many such conventional decappers being manually operated, limiting the number of cases that can be decapped in a set amount of time. Such conventional decappers also generally require modification or adjustment for each calibre case to be decapped. Similarly, suitable height adjustment is also required for each conversion suited to a specific calibre of case. With such conventional decappers, mixed-sized cases will generally cause significant jams and mechanical problems, further increasing the time and effort necessary in decapping mixed-size cases. Traditional methods typically use rim retention methods (commonly referred to as a shellplate) that are generally calibre or case dimension specific. Mixing cases of different sizes is a problem as they have different shellplate requirements, which can lead to additional expenditure in such shellplates.

Examples of such known decapping apparatus include U.S. Pat. No. 10,076,781 to Lee, U.S. Pat. No. 5,763,810 to Lee, U.S. Pat. No. 2,523,278 to Carl and CN 112025741 to the Changchun Equipment Technology Research Institute.

Accordingly, in light of the shortcoming with conventional decappers described above, the present invention seeks to propose possible solutions, at least in part, in amelioration of such shortcomings in the art of ammunition decapping.

SUMMARY OF THE INVENTION

According to a first aspect of the invention there is provided ammunition decapping apparatus comprising:

- a decapping platform;
- a case receptacle comprising two legs wherein each leg:
  - i) defines a pivot pivoting the leg on the decapping platform in an opposing mirror image manner to the other leg to define a case channel in-between the legs;
  - ii) defines a mating portion configured to complementarily engage the corresponding mating portion on the other leg to bring pivoting of the legs into reciprocal relationship;
  - iii) from one end, sequentially defines a bevelled end, a depression and a cavity that complementarily interacts with the corresponding bevelled end, depression and cavity, respectively, of the opposite leg to define a case feed point, a decapping receptacle and a discharge cavity along the case channel, wherein the case receptacle includes biasing means configured to bias the legs such that the respective bevelled ends are urged toward each other;
- a die gantry arranged over the decapping platform and including a reciprocating die mount;
- a case feeder configured to operatively feed a case upright onto the decapping platform;
- a case urger configured to urge a case fed from the case feeder into the case receptacle; and an actuator arrangement configured to actuate the case urger and die mount, so that a case is fed into the decapping receptacle and a die mounted in the die mount is able to decap the case.

In an embodiment, the decapping platform comprises a horizontal machine platform for supporting the case receptacle, die gantry, case feeder, case urger and actuator arrangement.

Typically, the mating portions complementarily engage each other to bring pivoting of the legs into reciprocal relationship so that the respective ends pivot towards or away from each other.

Typically, the respective mating portions comprise gear portions defined about at least part of the respective pivots of the legs within the case channel.

Typically, the respective one ends of the legs are bevelled to define the case feed point comprising a sloped entryway into the case channel.

Typically, the depressions on the respective legs that complementarily define the decapping receptacle are shaped and configured to accommodate various case sizes.

In an embodiment, the cavities on the respective legs that complementarily define the discharge cavity each includes an upper lip to facilitate in discharging a decapped case.

Typically, the pivot with mating portion is located sequentially after the respective cavities along each leg.

Typically, each leg defines a spring recess at an end distal from the bevelled end, said respective spring recesses complementarily engaging with each other to retain a captured spring therebetween as the biasing means.

Typically, the biasing means is configured to bias the legs together so that a case experiences frictional resistance from the legs when travelling along the case channel.

Similarly, the biasing means is configured to bias the legs together so that a case is frictionally captured within the decapping receptacle when travelling along the case channel.

Typically, the die gantry includes guide rails along which the reciprocating die mount travels.

Typically, the case urger includes guide rails along which the case feeder travels.

Typically, the case urger comprises a piston-like elongate member of comparable width as a case for urging a case along said case channel into the case receptacle.

Typically, the piston-like elongate member defines a case notch at an end thereof within which a case is held as said case is urged along the case channel.

Typically, the die mount and case urger are arranged in a sequentially reciprocating fashion where the case urger continuously urges cases along the case channel for the die mount to decap when such case is within the decapping receptacle of the case receptacle.

Typically, the case urger is configured to urge a case fed from the case feeder into the decapping receptacle via the case feed point so that a case already in the decapping receptacle is pushed along the case channel into the discharge cavity.

Typically, the case feeder is configured to operatively feed a case upright onto the decapping platform.

Typically, the case feeder is configured to operatively receive a plurality of cases for feeding in turn onto the decapping platform.

Typically, the case feeder is configured to feed the cases into the case receptacle under the influence of gravity.

Typically, the case feeder comprises a feeding tube with a diameter slightly larger than a case in order to feed a case lengthwise onto the decapping platform.

Typically, the case urger and case feeder are arranged to that the case urger regulates feeding of cases from the case feeder.

In an embodiment, the piston-like elongate member obstructs the case feeder as said piston-like member urges a case into the case channel.

Typically, the actuator arrangement comprises an electrical motor or similar prime mover with linkages for actuating the case urger and die mount to urge a case into the decapping receptacle and a die mounted in the die mount is able to decap the case in a continuous manner.

In an embodiment, the actuator arrangement includes a gearbox.

Typically, the decapping platform defines a discharge aperture below the discharge cavity of the case receptacle so that a decapped case falls therethrough under the influence of gravity.

Typically, the apparatus includes a case collector for receiving discharged decapped cases.

Typically, the case collector includes a discharge chute from the discharge aperture to the case collector.

Typically, the decapping platform defines a cap aperture below the decapping receptacle of the case receptacle so that a removed cap falls therethrough under the influence of gravity.

Typically, the apparatus includes a spent cap collector for receiving removed caps.

Typically, the spent cap collector includes a collection chute from the cap aperture to the cap collector.

According to a second aspect of the invention there is provided a method for decapping ammunition, said method comprising the steps of:

providing ammunition decapping apparatus in accordance with the first aspect of the invention; and decapping ammunition cases using such apparatus.

According to a further aspect of the invention there is provided a method for inserting primers into ammunition cases, said method comprising the steps of:

providing ammunition decapping apparatus in accordance with the first aspect of the invention; and inserting primers into said ammunition cases using such apparatus.

According to a further aspect of the invention there is provided ammunition decapping apparatus and a method for decapping ammunition, substantially as herein described and/or illustrated.

BRIEF DESCRIPTION OF THE DRAWINGS

The description will be made with reference to the accompanying drawings in which.

DETAILED DESCRIPTION OF EMBODIMENTS

Figure 1:
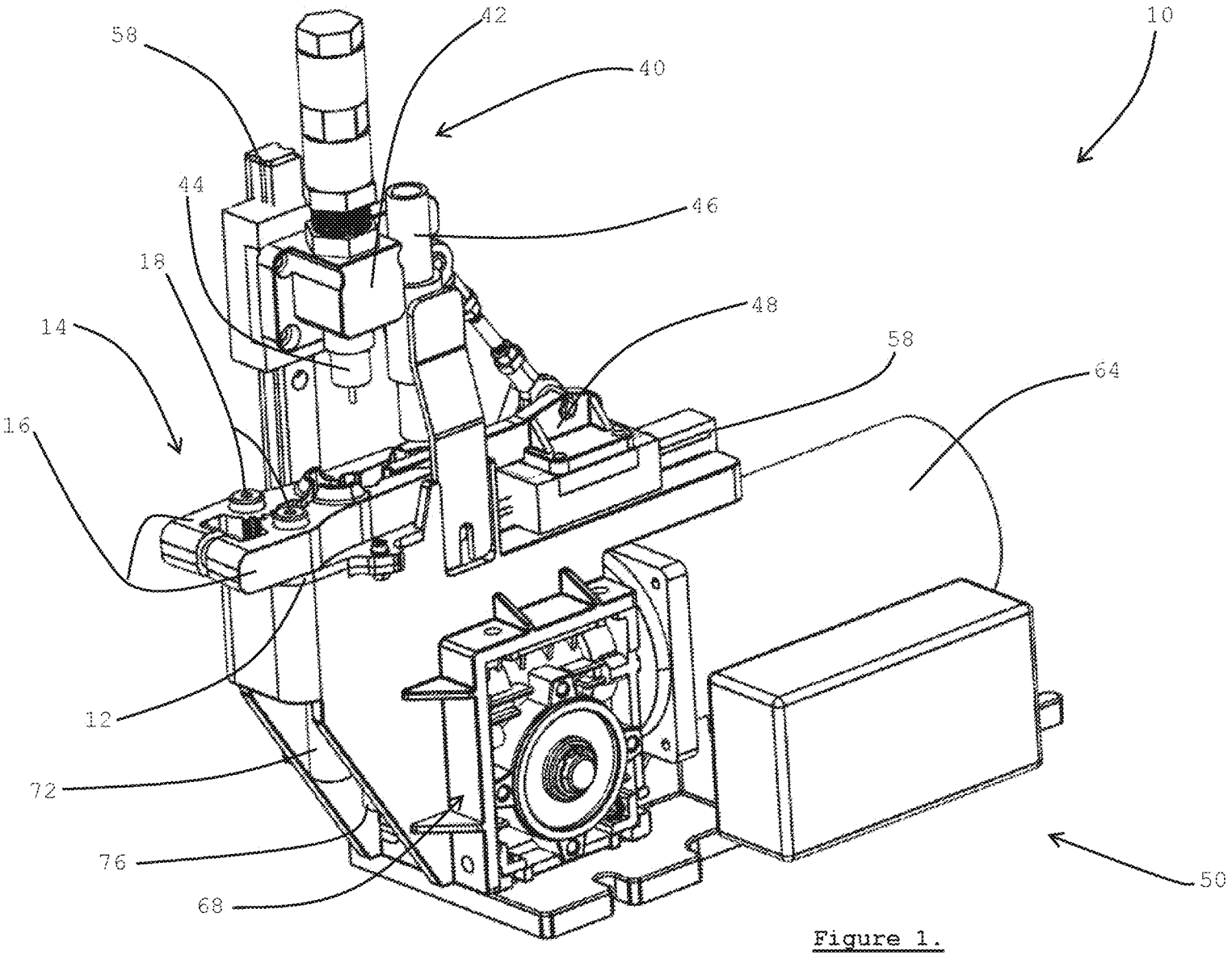
FIG. 1 is a diagrammatic right side view perspective representation of an embodiment of ammunition decapping apparatus in accordance with aspects of the present invention.
Figure 2:
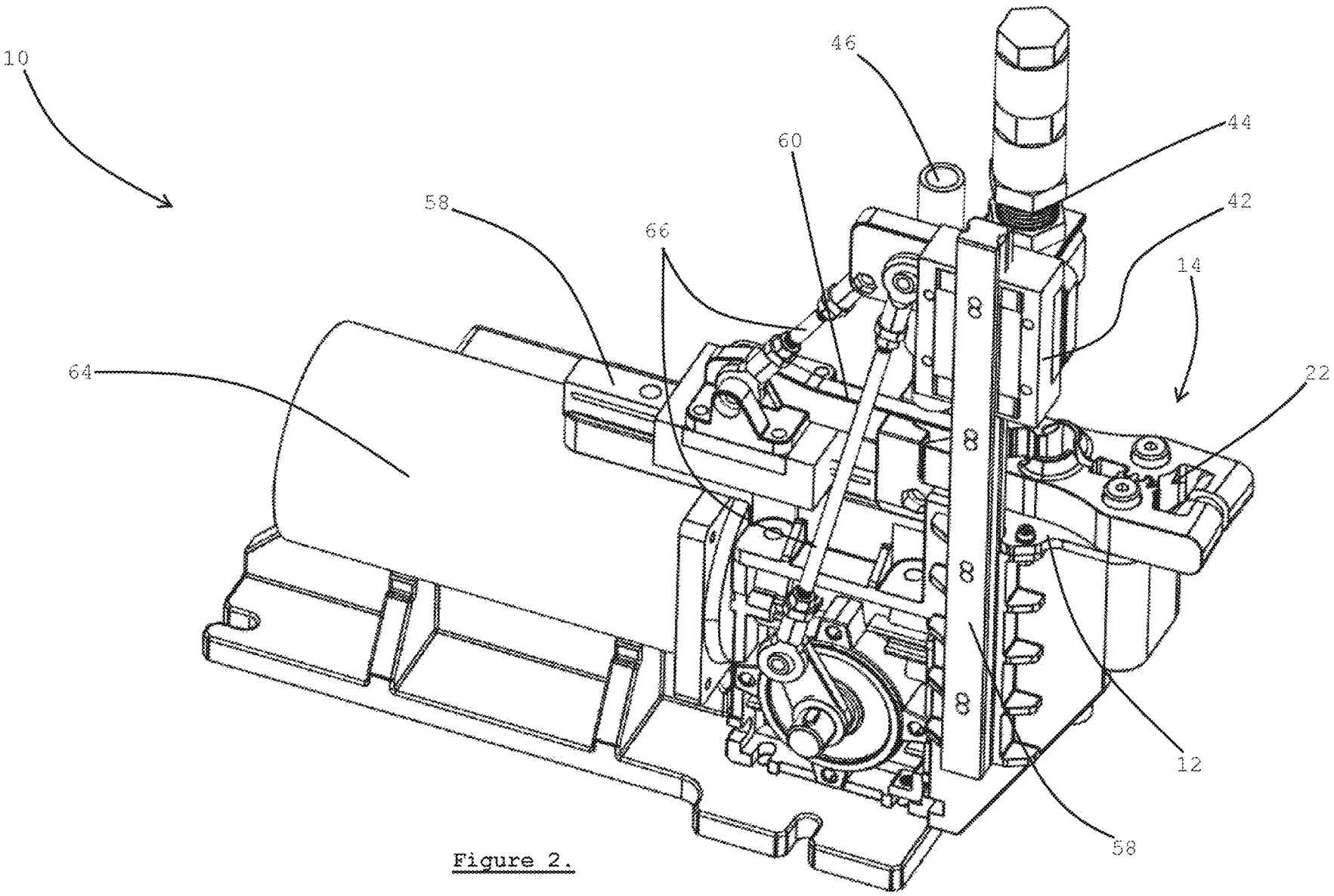
FIG. 2 is a diagrammatic left side perspective view representation of the decapping apparatus of FIG. 1.
Figure 3:
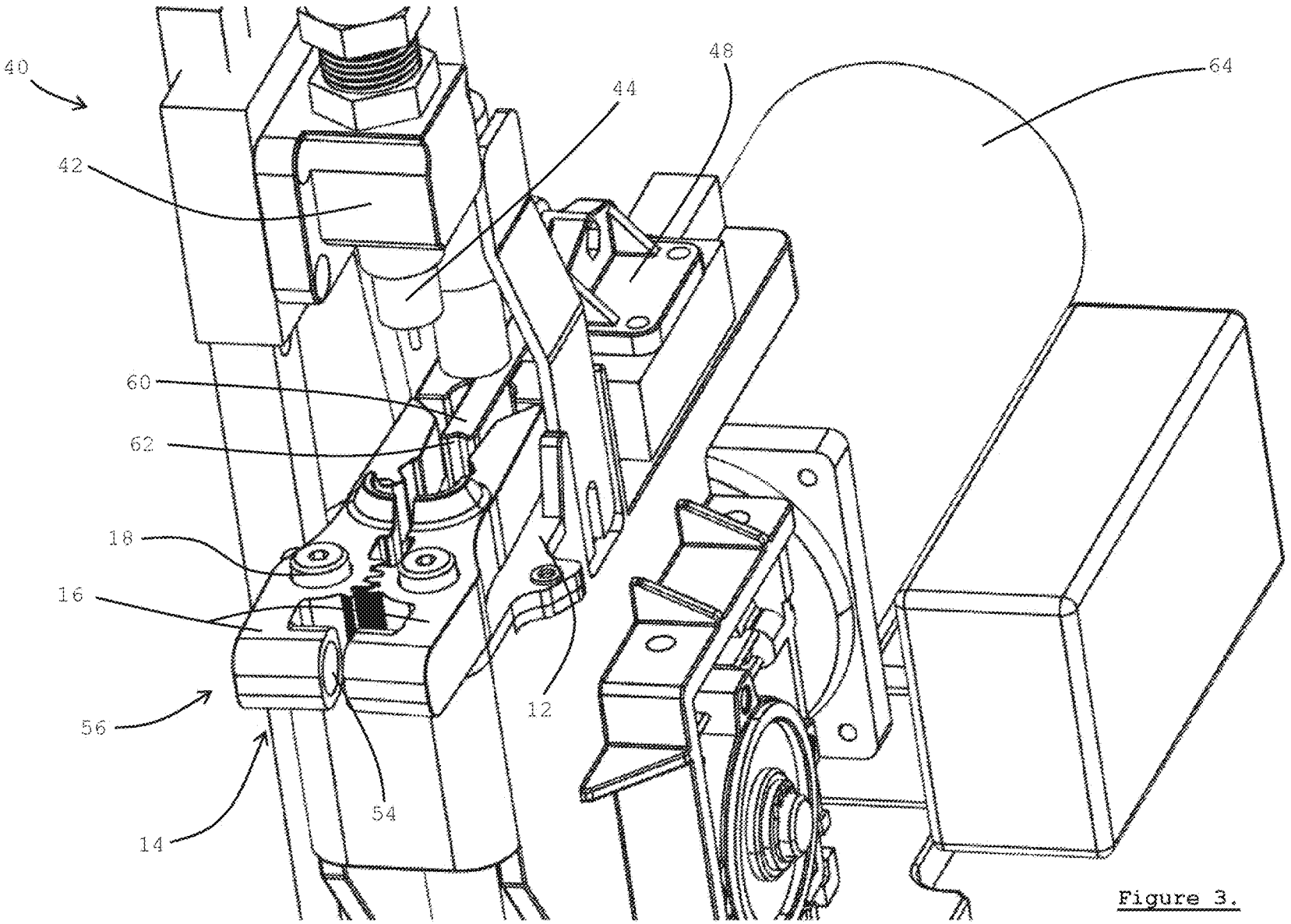
FIG. 3 is diagrammatic right front perspective view representation of the decapping apparatus of FIG. 1.
Figure 4:
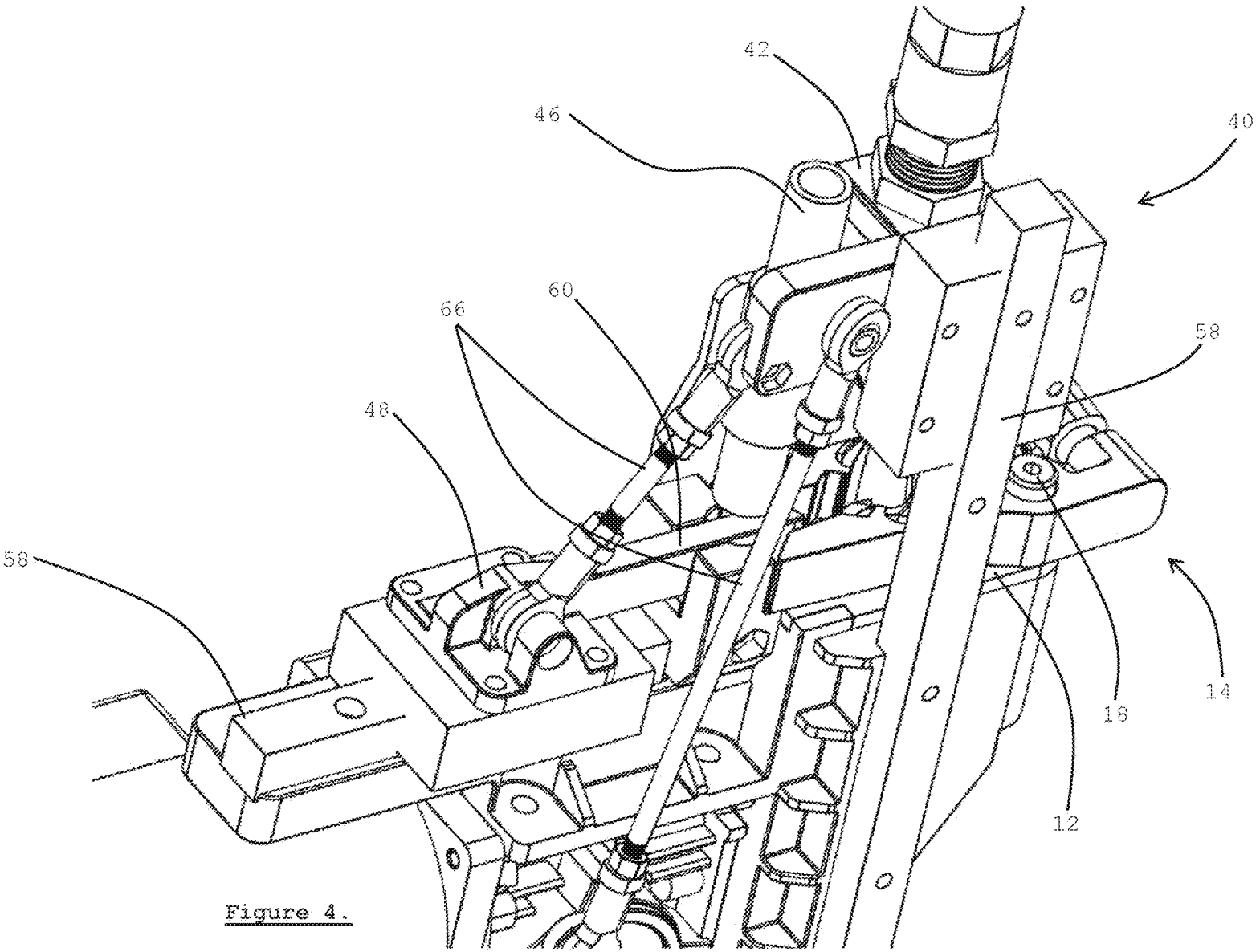
FIG. 4 is a diagrammatic left rear perspective view representation of the decapping apparatus of FIG. 1.
Figure 5:
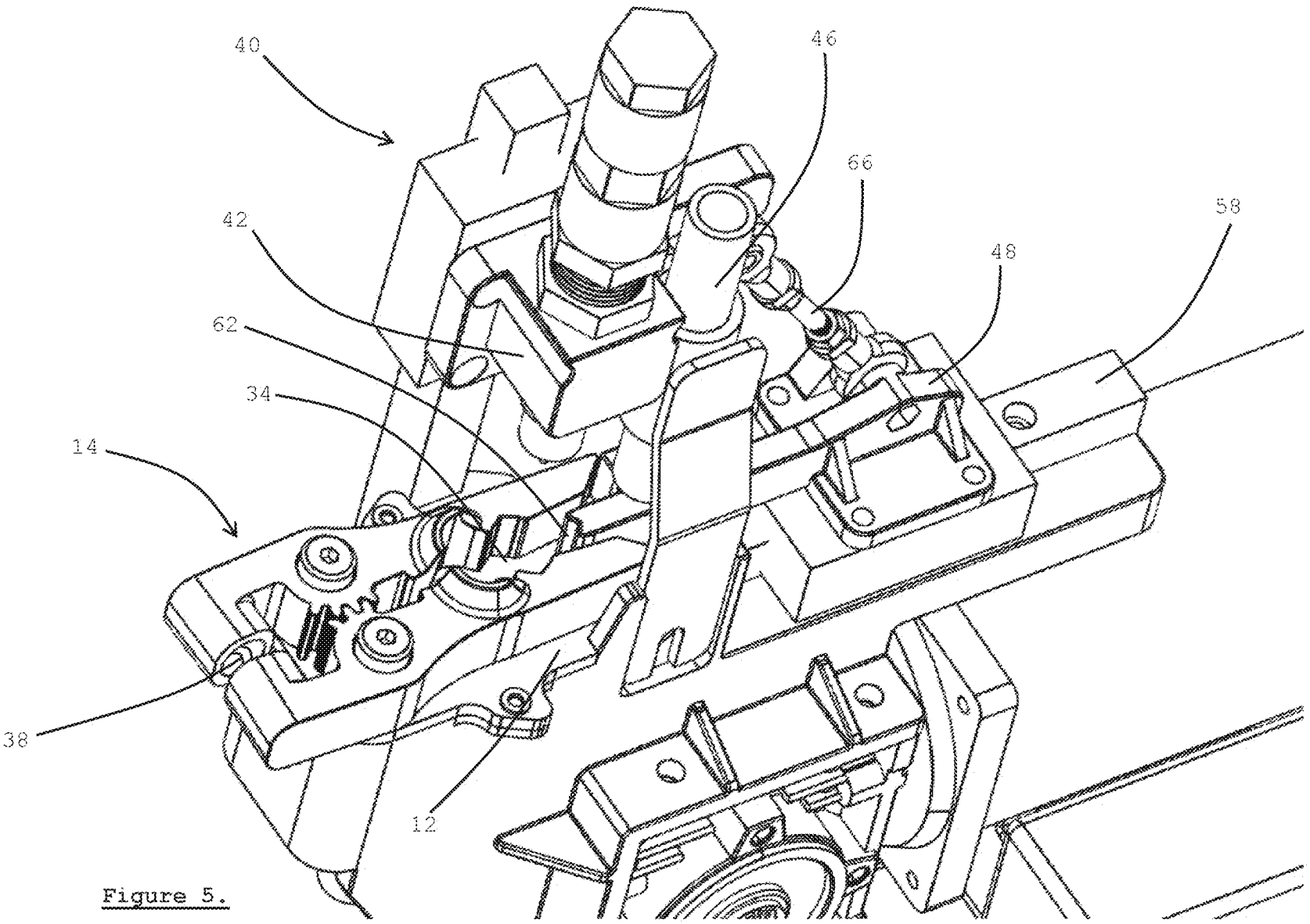
FIG. 5 is a diagrammatic right front perspective view representation of the decapping apparatus of FIG. 1.
Figure 6:
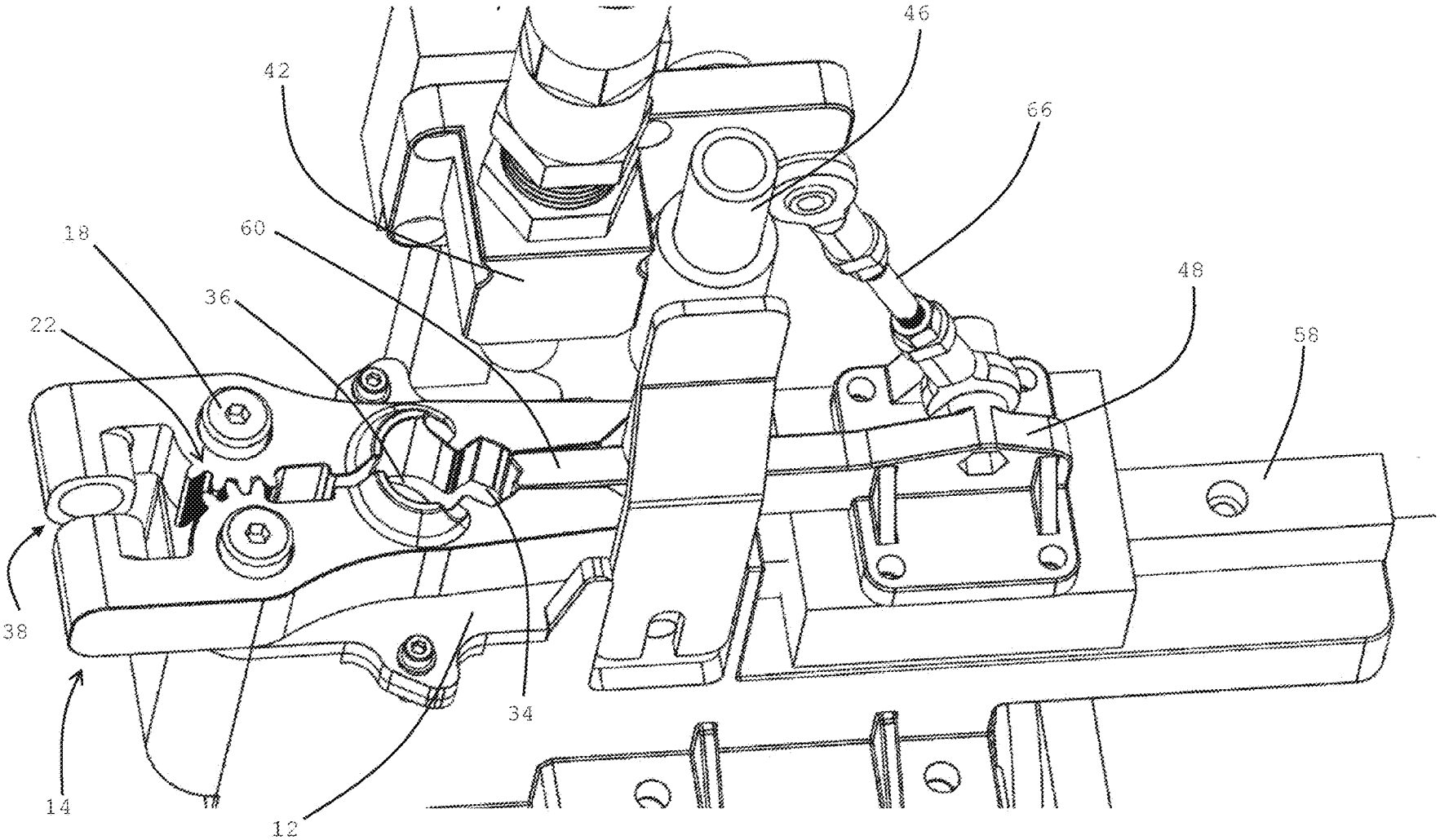
FIG. 6 is a diagrammatic right side perspective view representation of the decapping apparatus of FIG. 1.
Figure 7:
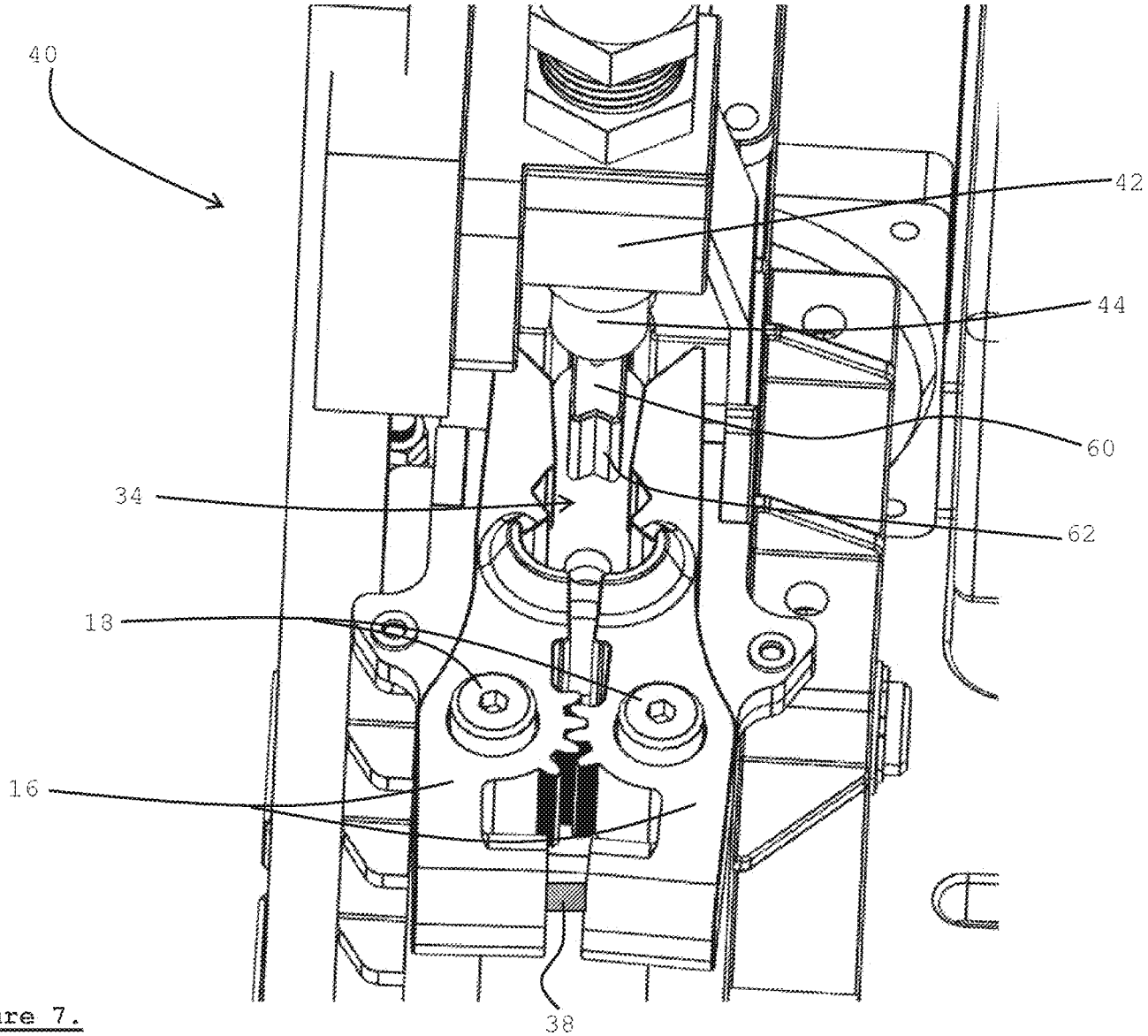
FIG. 7 is a diagrammatic front perspective view representation of the decapping apparatus of FIG. 1.
Figure 8:
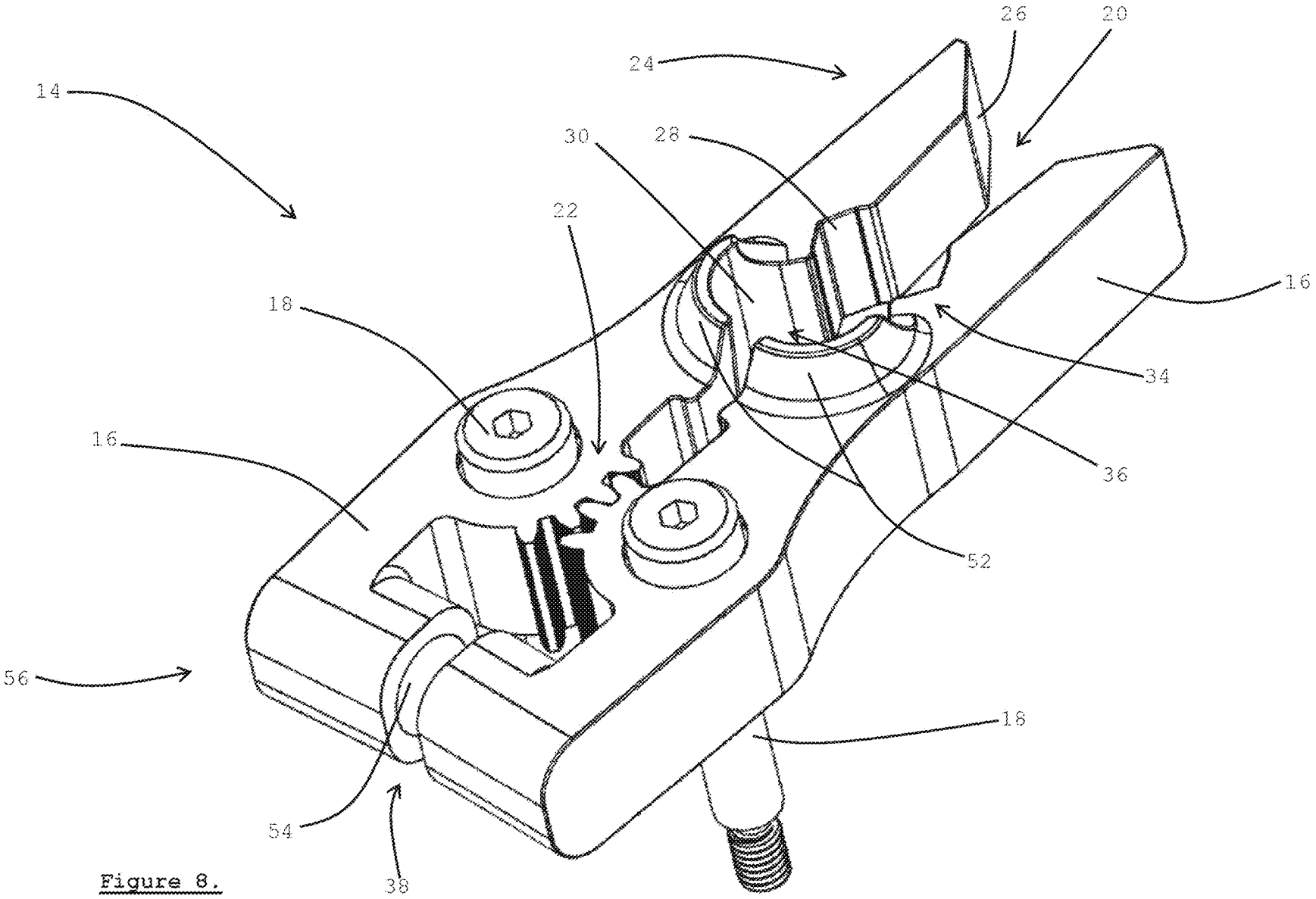
FIG. 8 is a diagrammatic perspective view representation of an embodiment of the case receptacle of the decapping apparatus of FIG. 1.

Further features of the present invention are more fully described in the following description of several non-limiting embodiments thereof. This description is included solely for the purposes of exemplifying the present invention to the skilled addressee. It should not be understood as a restriction on the broad summary, disclosure or description of the invention as set out above.

In the figures, incorporated to illustrate features of the example embodiment or embodiments, like reference numerals are used to identify like parts throughout. Additionally, features, mechanisms and aspects well-known and understood in the art will not be described in detail, as such features, mechanisms and aspects will be within the understanding of the skilled addressee.

With reference now to the accompanying figures, there is shown one possible example of an embodiment of ammunition decapping apparatus 10, in accordance with aspects of the present invention. Broadly, apparatus 10 comprises a decapping platform 12, a case receptacle 14, a die gantry 40, a case feeder 46, a case urger 48 and an actuator arrangement 50. Apparatus 10 has been conceived specifically to quickly and efficiently decap a large number of cases, including various mixed cases of various calibres. As such, apparatus 10 comprises specific configurations and adaptations, as described in more detail below, in order to achieve this function.

In a typical example, apparatus 10 comprises a decapping platform 12 which may be a horizontal machine platform, as shown, for supporting the case receptacle 14, die gantry 40, case feeder 46, case urger 48 and actuator arrangement 50 thereon, as shown. The skilled addressee is to appreciate that connecting structures are generally used to arranged the various components in suitable positions in order to fulfil their tasks, as described herein. As such connecting structures are known and examples thereof are shown in the figures, they will not be described in detail herein.

The case receptacle 14 is of particular configuration and is configured to perform a number of particular functions, as described below. The case receptacle 14 comprises two legs 16 with each leg 16 having a particular configuration to complementarily interact with the other leg.

Accordingly, in a typical embodiment each leg 16 defines a pivot 18 for pivoting the leg 16 on the decapping platform 12 in an opposing mirror image manner to the other leg 16, as shown, in order to define a case channel 20 in-between the legs 16. Each leg 16 also defines a mating portion 22 about said pivot 18, with such mating portion 22 complementarily engaging the corresponding mating portion 22 on the other leg 16 bringing pivoting of the legs 16 into reciprocal relationship.

Typically, the mating portions 22 complementarily engage each other to bring pivoting of the legs 16 into reciprocal relationship so that the respective ends 24 pivot towards or away from each other. In one embodiment, the respective mating portions 22 comprise gear portions defined about at least parts of the respective pivots 18, as shown, of the legs 16 within the case channel 20, as shown. The skilled addressee is to appreciate that, while a gear portion is exemplified, the mating portions 22 may differ and variations hereon are possible and within the scope of the present invention. For example, a mechanical linkage or the like may be used to achieve similar functionality, as described. Accordingly, such variations are expected and mechanical equivalents are expressly included within the scope of the present invention.

Each leg 16, from one end 24, sequentially defines a bevelled end 26, a depression 28 and a cavity 30 that complementarily interacts with the corresponding bevelled end 26, depression 28 and cavity 30, respectively, of the opposite leg 16 in order to define a case feed point 32, a decapping receptacle 34 and a discharge cavity 36 along the case channel 20, as shown. The case receptacle 14 also generally includes biasing means 38 which is configured to bias the legs 16 such that the respective bevelled ends 26 are urged toward each other, with the pivot 18 with mating portion 22 located sequentially after the respective cavities 30 along each leg 16, as shown. Variations hereon are possible and within the scope of the present invention.

Figure 9:
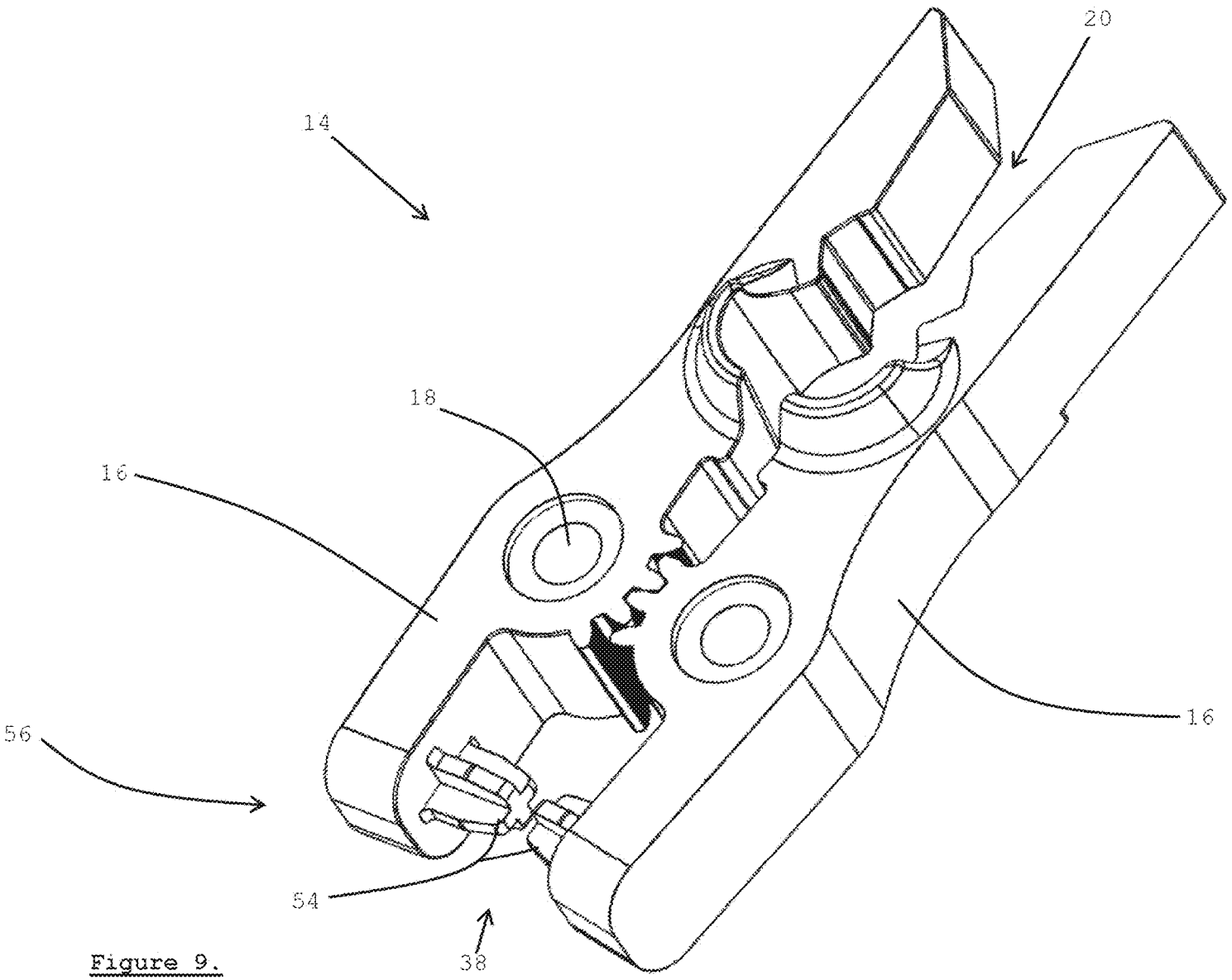
FIG. 9 is a diagrammatic perspective view representation of a further embodiment of the case receptacle of the decapping apparatus of FIG. 1.

Each leg 16 further defines a spring recess 54 at an end 56 distal from the bevelled end 24, said respective spring recesses 54 complementarily engaging with each other to retain a captured spring therebetween as the biasing means 38. Such a spring will exert a thrusting force on each spring recess 54 in order to bias the ends 24 toward each other. Variations on such biasing means 38 are possible. For example, as shown in FIG. 9, each leg 16 may define a suitable spring protrusion 54, similar in function to spring recess 54, for locating a spring therebetween as biasing means 38, or the like.

Importantly, the biasing means 38 is generally configured to bias the legs 16 together so that a case experiences frictional resistance from the legs 16 when travelling along the case channel 20, i.e. a pinching force is applied to a case within the case channel 20 by the legs 16. Similarly, the biasing means 38 is configured to bias the legs 16 together so that a case is frictionally captured within the decapping receptacle 34 when travelling along the case channel 20.

The respective one ends 24 of the legs 16 are generally bevelled to define the case feed point 32 which comprises a sloped entryway into the case channel 20. Such sloped entryway facilitates cases being urged into the case channel by the case urger 48, as described below.

The depressions 28 on the respective legs 16 that complementarily define the decapping receptacle 34 are typically shaped and configured to accommodate various case sizes. Additionally, in the exemplified embodiment, the cavities 30 on the respective legs 16 that complementarily define the discharge cavity 36 each includes an upper lip 52 to facilitate in discharging a decapped case.

In this manner, with the case receptacle 14 having this specific configuration, a case can be urged into the case channel 20 via the sloped case feed point 32 by the case urger 48. As the biasing means 38 causes the legs 16 to exert a lateral 'pinching' force onto the case, the case is automatically centred along the case channel 20 and can be captured within the decapping receptacle 34 when the case reaches such receptacle 34. The case receptacle 14 functions somewhat analogous to a conventional clothes peg, as described, in order to guide and automatically centre cases or various sizes travelling along the case channel 20 into the decapping receptacle 34.

In a further embodiment, the case receptacle 14 may also include an insert (not shown), typically of spring metal, proximate the legs 16 to provide for case rim encapsulation or retention where a lower edge of a case is prevented from uplift during decapping. Such an insert may take a variety of forms, including suitable protrusions defined on each leg 16, or the like.

Apparatus 10 further includes the die gantry 40 which is arranged over the decapping platform 12, as shown, and includes a reciprocating die mount 42 for receiving a variety of decapping dies 44, as required. The die mount 42 is arranged to locate such a die 44 directly above the decapping receptacle 34 of the case receptacle 14 in order to travel upwards or downwards in order to decap a case held captive in the decapping receptacle 34. The die gantry 40 generally includes guide rails 58 along which the reciprocating die mount 42 can travel.

Apparatus 10 also include the case feeder 46 which is generally configured to operatively feed a case upright onto the decapping platform 12. The case feeder 46 may be configured to operatively receive a plurality of cases for feeding in turn onto the decapping platform 12, i.e. one case at a time. In one embodiment, the case feeder 46 is configured to feed cases onto the decapping platform 12 under the influence of gravity. In such an example, the case feeder 46 may comprise a feeding tube, such as a flexible polymer or rubber tube, with a diameter slightly larger than a case so that a case is able to travel upright down the tube in order to feed a case lengthwise onto the decapping platform 12.

Further included is case urger 48 which is configured to urge a case fed from the case feeder 46 onto the decapping platform 12 into the case receptacle 14. Similar to the die mount 42, the case urger 48 typically includes guide rails 58 along which the case feeder 46 travels in a reciprocal manner. In the exemplified embodiment, the case urger 48 comprises a piston-like elongate member 60 of comparable width as a case for urging a case into and along the case channel 20 into the case receptacle 14. As shown, the piston-like elongate member 60 typically defines a case notch 62 at an end thereof within which a case is held as said case is urged along the case channel 20.

In a typical example, the die mount 42 and case urger 48 are arranged in a sequentially reciprocating fashion, where the case urger 48 continuously urges individual cases along the case channel 20 for decapping by a die 44 within the die mount 42 when such case is within the decapping receptacle 34 of the case receptacle 14. As described, the case urger 48 is generally configured to urge a case fed from the case feeder 46 into the decapping receptacle 34 via the case feed point 32 so that a case already in the decapping receptacle 34 is pushed along the case channel into the discharge cavity 36.

Importantly, the case urger 48 and case feeder 46 are generally arranged to that the case urger 48 regulates feeding of cases from the case feeder 46. In an embodiment, the piston-like elongate member 60 of the case urger 48 obstructs the case feeder tube 46 as said piston-like member 60 urges a case into the case channel 20, i.e. the member 60 moves underneath the case feeder tube 46 to prevent the next case therein from feeding onto the decapping platform 12 until such piston-like member 60 retracts underneath the case feeder tube 46, ready to the next case to be decapped.

Apparatus 10 also includes an actuator arrangement 50 which is generally configured to automatically actuate the case urger 48 and die mount 42, so that individual cases are fed from the case feeder 46 onto the decapping platform 12 in front of the piston-like member 60 so that the case urger 48 is able to urge said case into the decapping receptacle 34 of the case receptacle 14 and a die 44 mounted in the die mount 42 is able to decap the case. In a typical example, the actuator arrangement 50 comprises an electrical motor 64 or similar prime mover with a suitable gearbox, as required, with linkages 66 as shown for actuating the case urger 48 and die mount 42 to urge a case into the decapping receptacle 34 and a die 44 mounted in the die mount 42 is able to decap the case in a continuous manner. Such actuator arrangement 50 generally operates in a cyclic manner so allow ongoing, continuous and automatic decapping of a number of cases. Variations on such actuator arrangement 50 are possible, such as a hand crank for manual operation, a shaft for a conventional electric drill, etc.

Additionally, in one embodiment, the decapping platform 12 defines a discharge aperture below the discharge cavity 36 of the case receptacle 14 so that a decapped case falls therethrough under the influence of gravity. The apparatus 10 may also include a case collector for receiving discharged decapped cases. In one embodiment, the case collector includes a discharge chute from the discharge aperture to the case collector.

Similarly, in one embodiment, the decapping platform 12 defines a cap aperture below the decapping receptacle 34 of the case receptacle 14 so that a removed cap falls therethrough under the influence of gravity. The apparatus 10 may also include a spent cap collector for receiving such removed caps. Additionally, the spent cap collector may also include a collection chute from the cap aperture to the cap collector.

The skilled addressee is to appreciate that the present invention includes an associated method for decapping ammunition. Such a method broadly comprises the steps of providing ammunition decapping apparatus 10 as described herein, and decapping ammunition cases using such apparatus 10.

The skilled addressee is further to appreciate that the present invention further includes an associated method for inserting primers into ammunition cases. Such a method broadly comprises the steps of providing suitably-configured ammunition decapping apparatus 10 as described herein, and inserting primers into said ammunition cases using such apparatus 10. As the insertion of primers is essentially a reverse of the decapping process, apparatus 10 can easily be used to accommodate such large-scale insertion of primers or other mechanical functions such as primer pocket swaging, or the like.

In use, apparatus 10 can be used to decap a large number of cases automatically. For example, a plurality of cases may be loaded into the case feeder 46, which then feeds individual cases onto the decapping platform 12, as described. Actuator arrangement 50 is generally configured to continuously cycle the case urger to feed individual cases into the case channel 20 of case receptacle 14, where such case is then decapped by the die 44 in the die mount which is actuated in a corresponding reciprocal manner. As the case urger retracts, another case is fed from the case feeder 46 onto the platform 12 and urger into case channel 20. Such urging then pushed the already-decapped case into the discharge cavity 36 to fall under the influence of gravity into a case collector. Similarly, the removed cap falls into a separate cap collector. Similarly, apparatus 10 can be user for primer insertion, as described above.

Applicant believes it particularly advantageous that the present invention provides for apparatus 10 able to accommodate a range of case sizes and which generally does not require modifications to accommodate such different cases. The case receptacle 14 is able to accommodate multiple case types automatically without adjustment. In addition, apparatus 10 is generally insensitive to whether the cases are clean or dirty. Apparatus 10 is also able to automatically decap a large number of cases automatically, as well as insert primers in a similar fashion.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. As used herein, the term "and/or" includes any and all combinations of one or more of the associated listed items. No language in the specification should be construed as indicating any non-claimed subject matter as essential to the practice of the claimed subject matter.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It is to be appreciated that reference to "one example" or "an example" of the invention, or similar exemplary language (e.g., "such as") herein, is not made in an exclusive sense. Various substantially and specifically practical and useful exemplary embodiments of the claimed subject matter are described herein, textually and/or graphically, for carrying out the claimed subject matter.

Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise. Variations (e.g. modifications and/or enhancements) of one or more embodiments described herein might become apparent to those of ordinary skill in the art upon reading this application. The inventor(s) expects skilled artisans to employ such variations as appropriate, and the inventor(s) intends for the claimed subject matter to be practiced other than as specifically described herein.

Any method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. Ammunition decapping apparatus comprising:

a decapping platform;

a case receptacle comprising two legs wherein each leg:

i) defines a pivot pivoting the leg on the decapping platform in an opposing mirror image manner to the other leg to define a case channel in-between the legs;

ii) defines a mating portion configured to complementarily engage the corresponding mating portion on the other leg to bring pivoting of the legs into reciprocal relationship;

iii) from one end, sequentially defines a bevelled end, a depression and a cavity that complementarily interacts with the corresponding bevelled end, depression and cavity, respectively, of the opposite leg to define a case feed point, a decapping receptacle and a discharge cavity along the case channel, wherein the case receptacle includes biasing means configured to bias the legs such that the respective bevelled ends are urged toward each other;

a die gantry arranged over the decapping platform and including a reciprocating die mount;

a case feeder configured to operatively feed a case upright onto the decapping platform;

a case urger configured to urge a case fed from the case feeder into the case receptacle; and an actuator arrangement configured to actuate the case urger and die mount, so that a case is fed into the decapping receptacle and a die mounted in the die mount is able to decap the case.

2. Apparatus of claim 1, wherein the mating portions complementarily engage each other to bring pivoting of the legs into reciprocal relationship so that the respective ends pivot towards or away from each other.

3. Apparatus of claim 1, wherein the respective mating portions comprise gear portions defined about at least part of the respective pivots of the legs within the case channel.

4. Apparatus of claim 1, wherein the respective one ends of the legs are bevelled to define the case feed point comprising a sloped entryway into the case channel.

5. Apparatus of claim 1, wherein the depressions on the respective legs that complementarily define the decapping receptacle are shaped and configured to accommodate various case sizes.

6. Apparatus of claim 1, wherein the cavities on the respective legs that complementarily define the discharge cavity each includes an upper lip to facilitate in discharging a decapped case.

7. Apparatus of claim 1, wherein the pivot with mating portion is located sequentially after the respective cavities along each leg.

8. Apparatus of claim 4, wherein each leg defines a spring recess at an end distal from the bevelled end, said respective spring recesses complementarily engaging with each other to retain a captured spring therebetween as the biasing means.

9. Apparatus of claim 1, wherein the biasing means is configured to bias the legs together so that a case experiences frictional resistance from the legs and said case is frictionally captured within the decapping receptacle when travelling along the case channel.

10. Apparatus of claim 1, wherein the die gantry includes guide rails along which the reciprocating die mount travels.

11. Apparatus of claim 1, wherein the case urger includes guide rails along which the case feeder travels.

12. Apparatus of claim 1, wherein the case urger comprises a piston-like elongate member of comparable width as a case for urging a case along said case channel into the case receptacle.

13. Apparatus of claim 1, wherein the die mount and case urger are arranged in a sequentially reciprocating fashion where the case urger continuously urges cases along the case channel for the die mount to decap when such case is within the decapping receptacle of the case receptacle.

14. Apparatus of claim 1, wherein the case urger is configured to urge a case fed from the case feeder into the decapping receptacle via the case feed point so that a case already in the decapping receptacle is pushed along the case channel into the discharge cavity.

15. Apparatus of claim 1, wherein the case feeder is configured to operatively feed a case upright onto the decapping platform, the case feeder further configured to operatively receive a plurality of cases for feeding in turn onto the decapping platform.

16. Apparatus of claim 1, wherein the case feeder comprises a feeding tube with a diameter slightly larger than a case in order to feed a case lengthwise onto the decapping platform under the influence of gravity.

17. Apparatus of claim 1, wherein the case urger and case feeder are arranged so that the case urger regulates feeding of cases from the case feeder.

18. Apparatus of claim 1, wherein the actuator arrangement comprises an electrical motor or similar prime mover with linkages for actuating the case urger and die mount to urge a case into the decapping receptacle and a die mounted in the die mount is able to decap the case in a continuous manner.

19. Apparatus of claim 1, which includes a case collector for receiving discharged decapped cases and wherein the decapping platform defines a discharge aperture below the discharge cavity of the case receptacle so that a decapped case falls therethrough under the influence of gravity, the case collector including a discharge chute from the discharge aperture to the case collector.

20. Apparatus of claim 1, which includes a spent cap collector for receiving removed caps wherein the decapping platform defines a cap aperture below the decapping receptacle of the case receptacle so that a removed cap falls therethrough under the influence of gravity, the spent cap collector including a collection chute from the cap aperture to the cap collector.

* * * * *